US005931025A

United States Patent [19]

Lonati et al.

[11] Patent Number: 5,931,025

[45] Date of Patent: Aug. 3, 1999

[54] LOWERING SINKER ACTUATION CAM SET FOR CIRCULAR KNITTING MACHINES FOR FORMING STANDARD-TERRY KNITTING AND SANDWICH-TERRY KNITTING

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/081,272

[22] Filed: May 20, 1998

[51] Int. Cl.[6] ..... D04B 9/12

[52] U.S. Cl. ..... 66/217; 66/93; 66/108 R

[58] Field of Search ..... 66/93, 92, 91, 66/217, 104, 107, 108 R

[56] References Cited

U.S. PATENT DOCUMENTS

| | | | |
|---|---|---|---|
| 3,394,564 | 7/1968 | Brook | 66/93 |
| 3,937,037 | 2/1976 | Moody . | |
| 4,535,608 | 8/1985 | Plath et al. | 66/93 |
| 4,955,211 | 9/1990 | Neher | 66/93 |
| 5,184,483 | 2/1993 | Conti | 66/93 |

FOREIGN PATENT DOCUMENTS

| | | | |
|---|---|---|---|
| 692 960 | 11/1930 | France . | |
| 404257351 | 9/1992 | Japan | 66/217 |

*Primary Examiner*—F. Fields
*Assistant Examiner*—Larry D. Worrell, Jr.
*Attorney, Agent, or Firm*—Guido Modiano; Albert Josif

[57] ABSTRACT

A set of cams for actuating the lowering sinkers in circular knitting machines, for producing standard-terry knitting and sandwich-terry knitting. The cam set comprises cams and countercams which form a path for the heels of the lowering sinkers which have two lowering planes arranged at mutually different elevations for at least two yarns which are dispensed at a feed of the machine to form loops of terry knitting. The cam set also comprises, in the region of the path that corresponds to the descent of the needles of the needle cylinder to form loops of knitting with the two yarns dispensed at a feed of the machine, a cam which can move on command into two operating positions in order to produce at least one variation of the path formed by the cams and countercams. The movable cam has a first profile which can be engaged by the heels of the lowering sinkers and is suitable to produce, when the movable cam is in a first one of the two positions, a spacing of the sinkers from the axis of the needle cylinder with respect to the path in order to move the yarn, rested on the lower lowering plane of the lowering sinkers, away from the axis of the needle cylinder.

10 Claims, 4 Drawing Sheets

LOWERING SINKER ACTUATION CAM SET FOR CIRCULAR KNITTING MACHINES FOR FORMING STANDARD-TERRY KNITTING AND SANDWICH-TERRY KNITTING

BACKGROUND OF THE INVENTION

The present invention relates to a lowering sinker actuation cam set for circular knitting machines for stocking or hosiery-making particularly for forming standard-terry knitting and sandwich-terry knitting.

It is known that knitting with terry stitches is produced in circular knitting machines for stocking or hosiery-making by using specially-provided lowering sinkers provided with two lowering planes, i.e., the planes on which the yarns rest during the descent of the needles of the needle cylinder so as to form loops of knitting, arranged at two mutually different elevations and by dispensing, at one feed of the machine, two yarns which are taken up simultaneously by the needles. The two yarns are dispensed with a particular arrangement of the corresponding yarn guides and the lowering sinkers are actuated so that during the descent of the needles the two yarns are arranged respectively on the lower lowering plane and on the upper lowering plane of the sinkers, forming, for each needle, two loops of different length in which the longer loop provides the characteristic terry effect.

As an alternative to the use of lowering cams with two lowering planes, pairs of lowering sinkers or two side-by-side sinkers are also used which are accommodated in a same radial slot of the sinker ring, each being provided with a lowering plane which is located at a different vertical level than the lowering plane of the other sinker of the same pair. In practice, a pair of these sinkers corresponds to a sinker with two lowering planes located at two mutually different elevations.

In this case it is also possible to actuate only the sinkers with the lower lowering plane to form normal knitting.

Generally, in the manufacture of hosiery items the longer loops which produce the terry effect protrude on the back of the item, whilst the shorter loops are more visible on the right side. The shorter loops are generally formed by using a very thin yarn, usually made of helanca or other similar material, whilst the longer loops, i.e., the loops of terry, are formed with a cotton yarn.

As a consequence of this fact, with conventional terry-stitch knitting, referenced hereinafter as "standard terry" for the sake of clarity, when patterns are formed on the item said patterns have a poor definition, owing to the fact that the shorter loops of standard terry are visible on the right side of the item between the loops of the pattern.

In order to solve this problem, a particular kind of terry-stitch knitting has been devised which is known as "sandwich terry"; in this terry, during the forming of the double loops, the yarn that forms the shorter loops is shifted and kept toward the back of the item, so as to interfere as little as possible with the loops of the pattern and thus allow to achieve better definition of the pattern on the right side of the item.

This effect is achieved mainly by virtue of a particular actuation of the lowering sinkers in order to achieve, after resting the yarn on the lower lowering plane, a movement of the sinkers, or of the sinkers that have said lower lowering plane, away from the axis of the needle cylinder which correspondingly moves the yarn of the shorter loops toward the open side of the tip of the needles, i.e., on the back of the item, differently from ordinary terry knitting, in which the yarn of the shorter loops is shifted in the opposite direction.

The movement of the sinkers away from the axis of the needle cylinder is achieved by virtue of a suitable configuration of the path which is traced by the cams and countercams and in which the heels of the lowering sinkers engage and by using special sinkers.

As an alternative to this solution, special sinkers are also used instead of the sinkers used for standard terry knitting.

In any case, in order to switch from standard-terry knitting to sandwich-terry knitting, with conventional knitting or hosiery-making machine it is necessary to discontinue production and replace the cams that actuate the sinkers and replace the sinkers that engage said cams or at least the sinkers.

For this reason, with currently commercially available machines it is not possible to produce items which are knitted partly with standard-terry knitting and partly with sandwich-terry knitting.

This possibility, which has so far not been allowed, would instead be appreciated, since items manufactured exclusively with standard-terry stitches lead to an unsatisfactory aesthetic result in regions with patterns, whilst items formed exclusively with sandwich-terry knitting provide a better aesthetic result but are not as resistant as standard-terry items.

SUMMARY OF THE INVENTION

The aim of the present invention is to provide a set of cams for actuating the lowering sinkers for circular knitting or hosiery-making machines which allows to perform both standard-terry knitting and sandwich-terry knitting without requiring any replacement of machine parts.

Within the scope of this aim, an object of the invention is to provide a cam set which allows to produce items which are composed partly of standard-terry stitches and partly of sandwich-terry stitches.

Another object of the invention is to provide a set of cams for actuating lowering sinkers which can be installed without any problem in currently commercially available circular knitting or hosiery-making machines.

This aim, these objects and others which will become apparent hereinafter are achieved by a set of cams for actuating the lowering sinkers for circular knitting machines, for producing standard-terry stitches and sandwich-terry stitches, comprising cams and countercams which form a path for the heels of the lowering sinkers which have two lowering planes arranged at mutually different elevations for at least two yarns which are dispensed at a feed of the machine to form loops of terry knitting, characterized in that it comprises, in the region of said path that corresponds to the descent of the needles of the needle cylinder to form loops of knitting with the two yarns dispensed at a feed of the machine, a cam which can move on command into two operating positions in order to produce at least one variation of the path followed by the heels of the sinkers due to said cams and countercams; said movable cam having a first profile which can be engaged by the heels of the sinkers and is suitable to produce, when said movable cam is in a first one of said two positions, a spacing of the sinkers from the axis of the needle cylinder with respect to said path in order to move the yarn, rested on the lower lowering plane of the sinkers, away from the axis of the needle cylinder.

BRIEF DESCRIPTION OF THE DRAWINGS

Further characteristics and advantages of the invention will become apparent from the description of a preferred but not exclusive embodiment of the cam set according to the invention, illustrated only by way of non-limitative example in the accompanying drawings, wherein.

DESCRIPTION OF THE PREFERRED EMBODIMENTS

Figure 1:
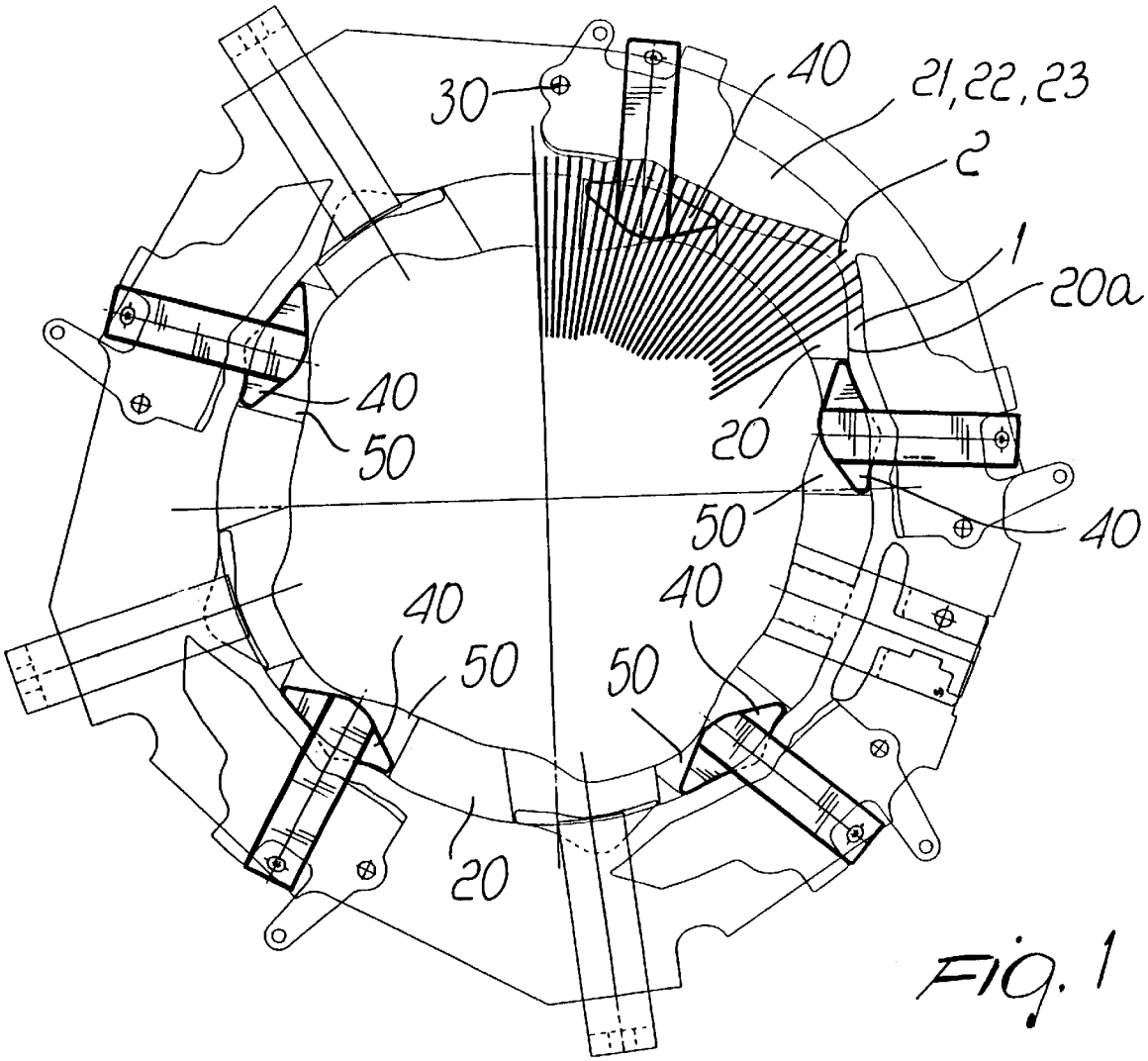
FIG. 1 is a schematic top plan view of the actuation cam set according to the invention, with some elements shown in phantom lines for the sake of clarity, with the movable cam in a first position.

With reference to the above figures, the cam set according to the invention comprises cams and countercams which form, as a whole, a path 1 for the heels 2*a*, 3*a*, 4*a* of the lowering sinkers, generally designated by the reference numerals 2, 3, 4, which are accommodated in a per se known manner within radial slots formed in the sinker ring 5, which is arranged coaxially around the needle cylinder 6 proximate to the upper end thereof.

It should be noted that the present description is given with reference to a machine which uses sinker pairs, i.e., two sinkers which are arranged within the same radial slot of the sinker ring 5.

More particularly, in each radial slot of the sinker ring 5 there are either a sinker 2 and a sinker 3 or a sinker 2 and a sinker 4. In practice, the slots of half of the sinker ring 5 accommodate sinker pairs composed of sinkers 2 and sinkers 3, whilst the slots of the other half of the sinker ring 5 accommodate sinker pairs composed of a sinker 2 and a sinker 4.

The sinker 2, or stitch sinker, has a lowering plane 7, whilst the sinkers 3 and 4, or terry sinkers, have lowering planes 8 and 9 which are located at a higher level than the lowering plane 7 of the sinker 2.

In practice, the lowering planes 8 and 9 of the sinkers 3 and 4 form longer loops, i.e., the characteristic terry stitches, during the descent of the needles 10 arranged in the needle cylinder 6.

The lowering plane 7 is formed between a pair of beaks 11 and 12 of the sinker 2, in a per se known manner.

The set of sinker actuation cams comprises, in a per se known manner, a fixed annular cam 20 which runs around the axis 6*a* of the needle cylinder and has an outer profile 20*a* provided, in a per se known manner, with portions which move gradually away from the axis 6*a* of the needle cylinder and with portions which gradually move closer to said axis 6*a* in order to produce the characteristic radial movement of the sinkers in the corresponding slots of the sinker ring 5.

The set of actuation cams also comprises movable countercams 21, 22 and 23 which face, with their profile 21*a*, 22*a* and 23*a*, the profile 20*a* of the annular cam 20.

The movable countercams 21, 22 and 23 are arranged at mutually different elevations so as to match the different elevation of the heels 2*a*, 3*a* and 4*a* of the lowering sinkers 2, 3 and 4.

More particularly, the movable countercam 21 is located at such an elevation as to interfere with the heel 2*a* of the sinkers 2, which is higher than the heel 3*a* of the sinkers 3. The movable countercam 22 is arranged at a lower level than the movable countercam 21, so that it can interfere both with the heel 2*a* of the sinkers 2 and with the heel 3*a* of the sinkers 3, whilst the movable countercam 23 is located below the bottom of the radial slots of the sinker ring 5, so that it can interfere only with the heel 4*a* of the sinkers 4 that protrudes downward from said slots.

The movable countercams 21, 22 and 23 are packed together and are pivoted to the sinker ring 5 about an axis 30 which is parallel to the axis 6*a* of the needle cylinder 6, so that they can be moved from an inactive position, in which their profile 21*a*, 22*a* and 23*a* is spaced from the profile 20*a* of the annular cam 20 so as not to interfere with the corresponding heels of the sinkers 2, 3 and 4, to an active position, in which said movable countercams are closer, with their profile 21*a*, 22*a* and 23*a*, to the profile 20*a* of the annular cam 20, so as to interfere with the corresponding heels of the sinkers 2, 3 and 4.

The movable countercams 21, 22 and 23 can oscillate individually about the axis 30, for example by means of actuators of the electromagnetic, pneumatic, mechanical type or of other conventional types, according to the requirements.

It should be noted that by keeping the movable countercams 22 and 23 in the inactive position, i.e., in the position in which they have no effect on the sinkers 3 and 4, only the sinkers 2 are actuated due to the operating position of the movable countercam 21, producing knitting with standard stitches.

If the movable countercams 21 and 22 are moved into the active position, the result is knitting with terry stitches on half of the needles of the needle cylinder 6, whilst if the movable countercams 21 and 23 are moved into the active position, the result is knitting with terry stitches on the other half of the needles of the needle cylinder 6; if the movable countercams 21, 22 and 23 are moved into the active position, the result is knitting with terry stitches on all the needles of the needle cylinder 6, except of course for any needle selections which remove some of the needles from knitting.

According to the invention, the set of actuation cams comprises, in the region of the path 1 that corresponds to the descent of the needles 10 to form loops of knitting with the two yarns dispensed at a feed of the machine, a movable cam 40 which can be moved on command into two active positions in order to produce at least one variation of the path followed by the heels 2*a* of the sinkers 2 with respect to the path 1.

More particularly, the movable cam 40 can be moved from a first position, in which it produces, with its profile 40*a*, a spacing of the sinkers 2 with respect to the axis 6*a* of the needle cylinder and with respect to the path 1 so as to shift the yarn 60 rested on the lower lowering plane 7 of the sinkers 2 away from the axis 6*a* of the needle cylinder 6.

The movable cam 40 can move from said first position to a second position in which it does not interfere with the heels 2*a* of the sinkers 2 but instead acts, with another second profile 40*b*, on the back 2*b* of the sinkers 2 which is directed toward the heel 2*a*, so as to anticipate the motion of the sinkers 2 toward the axis 6*a* of the needle cylinder 6 in order to shift the yarn 60, rested on the lower lowering plane 7 of the sinkers 2, toward the axis 6*a* of the needle cylinder, as will become apparent hereinafter.

The movable cam 40 is partially superimposed on the annular cam 20 and is slidingly accommodated within a recess 50 formed on the upper face of the annular cam 20. Said recess 50 is meant to allow the sliding of the movable cam 40 in a substantially radial direction with respect to the axis 6*a* of the needle cylinder 6 and simultaneously to guide the movable cam 40 during said movement.

The movable cam 40 lies on a plane which is substantially perpendicular to the axis 6*a* of the needle cylinder and can move, in order to pass from the first position to the second position, along a direction which is substantially radial with respect to the needle cylinder 6.

The movable cam 40 has a first profile 40*a* which is formed by the side of the cam that is directed away from the axis 6*a* of the needle cylinder 6, i.e., faces the movable countercams 21, 22 and 23 and engages the side of the heels 2*a* of the sinkers 2 that is directed toward the axis 6*a* of the needle cylinder 6.

The movable cam 40 also has a second profile 40*b*, which is formed by the side of the movable cam 40 that is directed toward the axis 6*a* of the needle cylinder 6 and can engage, when the movable cam 40 is moved into the second position, the back 2*b* of the sinker 2 that is directed toward the heel 2*a*.

The first profile 40*a* is constituted, along the direction of motion of the sinkers with respect to the cams and countercams that actuate them, by a first portion which moves gradually away from the axis 6*a* of the needle cylinder 6 and is followed by a second portion which gradually approaches the axis of the needle cylinder.

The second profile 40b of the movable cam 40 is constituted by a first portion which gradually approaches the axis 6*a* of the needle cylinder 6 and is followed by a second portion which gradually moves away from the axis 6*a* of the needle cylinder 6.

In practice, the movable cam 40 is shaped so as to have a substantially diamond-like plan shape with rounded corners.

The side of the countercam 21 that faces the first profile of the movable cam 40 has, at the end of the first portion of the first profile 40*a* of said movable cam 40, a recessed region 70 to allow the movement of the sinkers 2 away from the axis 6*a* of the needle cylinder 6.

The movement of the movable cam 40 from the first position to the second position or vice versa can be performed by virtue of conventional actuators, for example actuators of the mechanical, pneumatic, electromagnetic type, etcetera.

Figure 2:
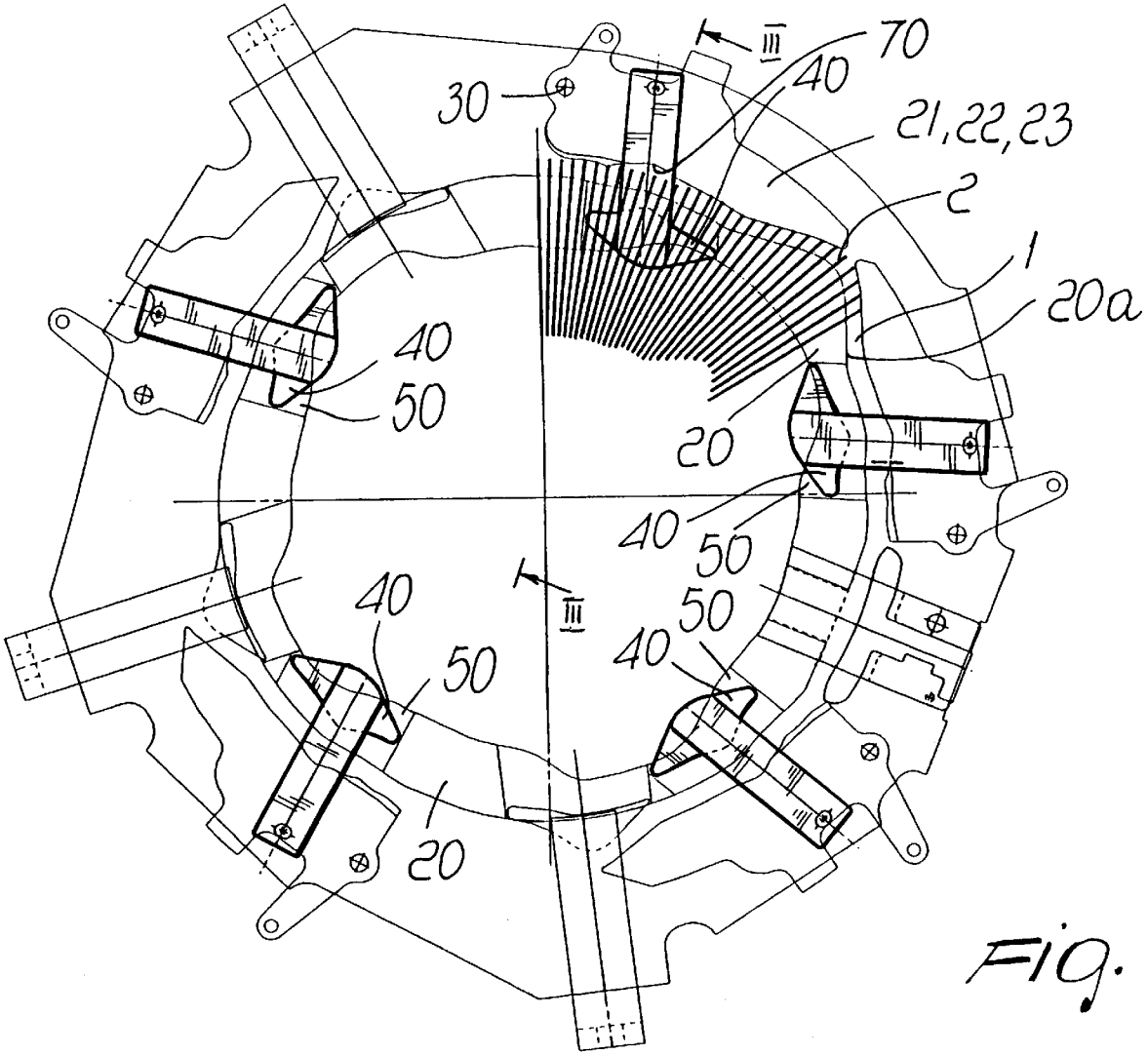
FIG. 2 is a top plan view, similar to FIG. 1, of the actuation cam set according to the invention with some elements shown in phantom lines for the sake of clarity, with the movable cam in a second position.
Figure 3:
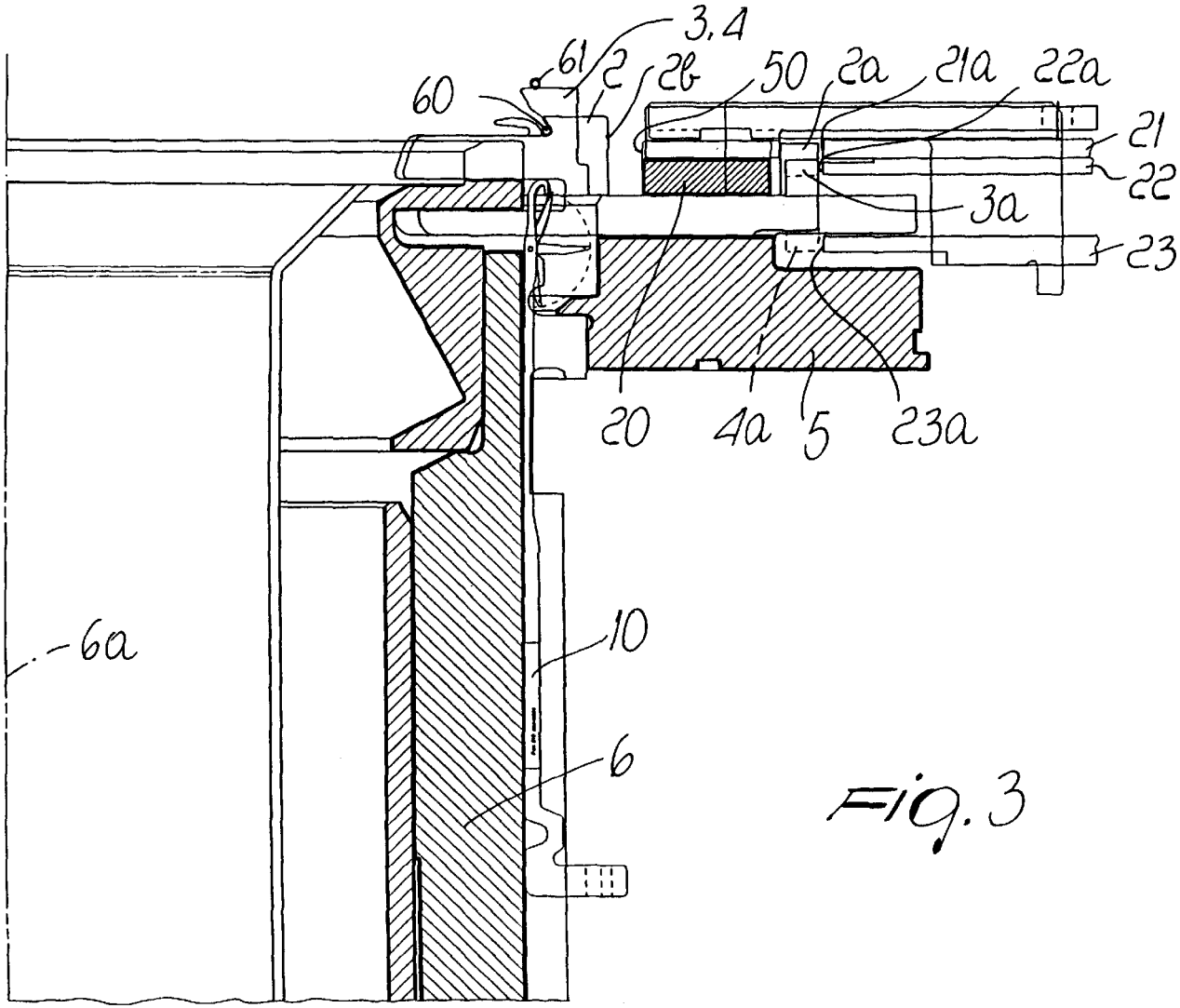
FIG. 3 is an enlarged-scale sectional view of FIG. 2, taken along the plane III—III, with some elements shown in phantom lines.
Figure 4:
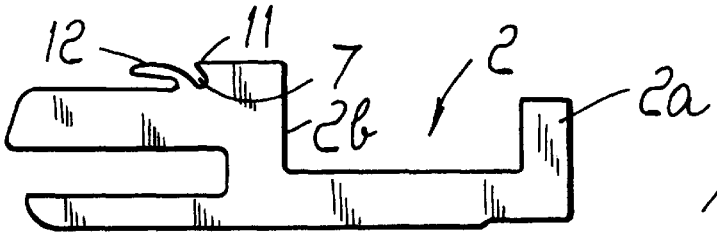
FIGS. 4 to 6 are views of three types of lowering sinker which can be used with the actuation cam set according to the invention.
Figure 5:
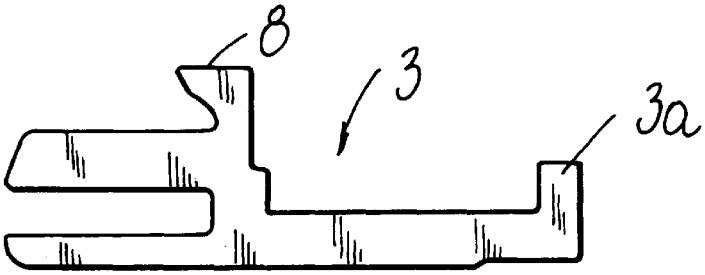
Figure 6:
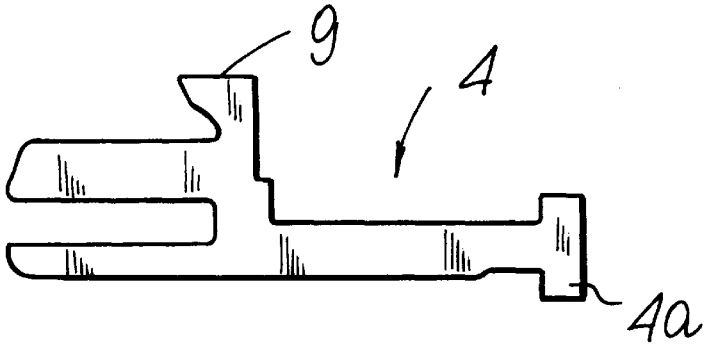
Figure 7:
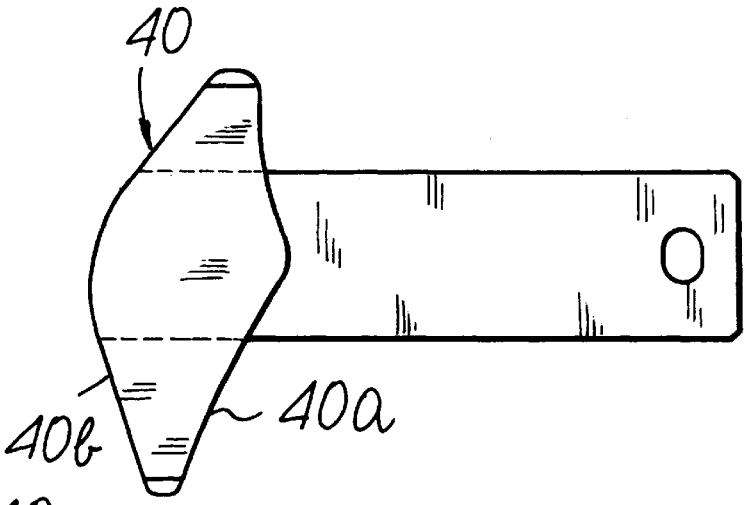
FIG. 7 is a bottom plan view of the movable cam.
Figure 8:
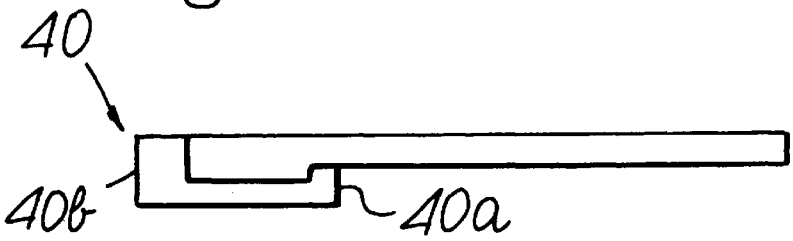
FIG. 8 is a lateral elevation view of the movable cam.

For the sake of completeness in description, it should be noted that FIGS. 1 and 2 relate to a circular hosiery knitting machine with four feeds or drops and that there is a movable cam 40 for each feed.

The operation of the machine provided with the set of cams for actuating the lowering sinkers according to the invention, in the production of terry knitting, is as follows.

If one wishes to produce standard-terry knitting, the movable cam 40 is moved into the second position (FIG. 2). When the movable cam 40 is in this position, the two yarns 60 and 61 dispensed at a feed of the machine rest, when the needles 10 begin their descent, respectively on the lowering plane 7 of the sinkers 2 and on the lowering plane 8 or 9 of the sinkers 3 or 4. When the sinkers 2 engage, with their back 2*b*, along the second profile of the movable cam 40, the sinkers 2 are moved toward the axis 6*a* of the needle cylinder 6. This movement also produces the movement of the yarn 60, which rests on the lowering plane 7 of the sinkers 2, toward the axis 6*a* of the needle cylinder and therefore the movement of said yarn 60, which constitutes the yarn by means of which the shorter loops of knitting are formed, toward the right side of the item.

If one wishes to form sandwich-terry knitting, the movable cam 40 is moved into the first position (FIG. 1) so that the sinkers 2 are moved, after the yarn 60 has rested on the lowering plane 7, away from the axis 6*a* of the needle cylinder 6, consequently positioning the yarn 60, i.e., the yarn that is used to form the shorter loops, on the back of the item.

It should be noted that although the invention has been described with reference to a machine which uses sinker pairs in the radial slots of the sinker ring 5, the set of cams for actuating lowering sinkers according to the invention can in any case be used with machines which use a single sinker for each radial slot of the sinker ring 5 of the type provided with two lowering planes located at two mutually different elevations.

In practice it has been found that the invention fully achieves the intended aim, since it allows to provide, with a single set of sinker actuation cams and therefore without requiring any replacement of the elements that compose the machine, both standard-terry knitting and sandwich-terry knitting.

By virtue of this fact it is also possible to produce items composed of parts formed with standard-terry knitting, for example in regions requiring particular strength, and parts formed with sandwich-terry knitting, for example at regions with pattern stitches.

The set of lowering sinker actuation cams thus conceived is susceptible of numerous modifications and variations, all of which are within the scope of the inventive concept; all the details may furthermore be replaced with other technically equivalent elements.

In practice, the materials used, as well as the dimensions, may be any according to the requirements and the state of the art.

What is claimed is:

1. A set of cams for actuating lowering sinkers in a circular knitting machine, for producing standard-terry stitches and sandwich-terry stitches, the machine including a needle cylinder, needles arranged at the needle cylinder about an axis thereof and actuatable for descent motion and lowering sinkers for at least two yarns, said sinkers being provided with respective heels and lowering planes, said cam set comprising: cams and countercams which form a path for the heels of the lowering sinkers, said sinkers having two said lowering planes arranged at mutually different elevations for said at least two yarns which are dispensed at a feed of the machine to form loops of terry knitting; a movable cam which is located in a region of said path that corresponds to the descent of the needles of the needle cylinder to form loops of knitting with the two yarns dispensed at a feed of the machine, said movable cam being movable on command into two operating positions in order to produce at least one variation of the path followed by the heels of the sinkers due to said cams and countercams; a first profile provided at said movable cam for being engageable by the heels of the sinkers so as to produce, when said movable cam is in a first one of said two positions, a spacing of the sinkers from the axis of the needle cylinder with respect to said path in order to move the yarn, rested on the lower lowering plane of the sinkers, away from the axis of the needle cylinder.

2. The cam set of claim 1, wherein said movable cam has a second profile, said second profile being engageable by the sinkers when said movable cam is in the second one of said two positions, so as to anticipate, with respect to said path, the movement of the sinkers toward the needle cylinder axis in order to move the yarn, rested on the lower lowering plane of the sinkers, toward the needle cylinder axis.

3. The cam set of claim 2, wherein said movable cam lies on a plane which is substantially perpendicular to the needle cylinder axis, and is movable on command in order to pass from the first one of said two positions to the second one of said two positions, along a direction which is substantially radial with respect to the needle cylinder.

4. The cam set of claim 3, wherein said first profile is formed by a side of said movable cam that is directed away from the needle cylinder axis, said first profile, when said movable cam is in said first position, engaging a side of the heels of the sinkers that is directed toward the needle cylinder axis.

5. The cam set of claim 3, wherein said second profile is formed by the side of said movable cam that is directed toward the needle cylinder axis, said second profile being engageable, when said movable cam is in said second position, by a back part of said sinkers that lies opposite with respect to the heels thereof.

6. The cam set of claim 3, wherein said first profile of the movable cam has a first portion which gradually moves away from the needle cylinder axis and is followed by a second portion which moves gradually closer to the needle cylinder axis.

7. The cam set of claim 3, wherein said second profile has a first portion which moves gradually closer to the needle cylinder axis and is followed by a second portion which moves gradually away from the needle cylinder axis.

8. The cam set of claim 3, wherein said movable cam is substantially shaped, in plan view, like a diamond with rounded corners.

9. The cam set of claim 4, wherein any of the cam or countercam that faces a side of said movable cam that faces away from the needle cylinder has a recessed region in order to allow movement of the sinkers away from the needle cylinder when said movable cam is in said first position.

10. The cam set of claim 3, wherein said path forming cams lie in a substantially annular configuration around the needle cylinder axis with at least one path forming cam having a recess formed on an upper face thereof, said movable cam partially overlapping said at least one path forming cam and being slidingly accommodated within said recess.

* * * * *